US006392171B1

(12) United States Patent
Linhuang

(10) Patent No.: US 6,392,171 B1
(45) Date of Patent: May 21, 2002

(54) INTEGRAL MULTI-SWITCH

(76) Inventor: Chiung-Ying Linhuang, No. 29, Hui Min Shin Village, Ma Gong City, Peng Hu Hsien (TW)

( * ) Notice: Subject to any disclaimer, the term of this patent is extended or adjusted under 35 U.S.C. 154(b) by 0 days.

(21) Appl. No.: 09/535,543

(22) Filed: Mar. 27, 2000

(51) Int. Cl.[7] ..... H01R 19/00
(52) U.S. Cl. ..... 200/51.02; 200/51.05
(58) Field of Search ..... 200/5 A, 7 R, 200/5 E, 5 B, 5 C, 50.32, 50.33, 50.35, 50.1 R, 51.02, 51.05, 51.09, 51.11

(56) References Cited

U.S. PATENT DOCUMENTS 3,742,171 A * 6/1973 Howe ..... 200/168 G
4,352,964 A * 10/1982 English ..... 200/5 A
4,875,871 A * 10/1989 Booty, Sr. et al. ..... 439/209
4,929,807 A * 5/1990 Sorenson ..... 200/296
5,347,095 A * 9/1994 Zeder ..... 200/51.09
5,451,729 A * 9/1995 Onderka et al. ..... 200/18
6,054,657 A * 4/2000 Liao ..... 200/51.02

* cited by examiner

*Primary Examiner*—P. Austin Bradley
*Assistant Examiner*—Nhung Nguyen
(74) *Attorney, Agent, or Firm*—Rosenberg, Klein & Lee

(57) ABSTRACT

An integral multi-switch comprises a switch box, conducting plates and switches. The switch box comprises at least two troughs to receive the conducting plates and switches therein. A first conducting plate is an one piece plate which inputs electric power, a second conducting plate outputs the power, and is connected to the first conducting plate by the switch. A third conducting plate is a ground connection. Each conducting plate has a conduct point in each trough which constitutes the multi-switch device, the switch box has a pushing plate which slides vertically to active the switches. The second and third conducting plates extend various clips which provide multi-contact for conduction.

10 Claims, 21 Drawing Sheets

INTEGRAL MULTI-SWITCH

BACKGROUND OF THE INVENTION

1. Field of the Invention

This invention relates to an integral multi-switch, and more particularly to a switch box requires little or no soldering method.

2. Description of Prior Art

The multi switches currently on the market are mostly used as an extension cord or a single switch to a multi switch box, as shown in FIGS. 14 and 15. A receptacle A comprises a number of receptacle moldings A1. Each molding A1 is controlled by a single switch A2 which has a various types, such as a light indicator within the switch or an overload protector which shots off the power when overload is detected,) to be conducted or disconnected from electric power. The first connecting point A12 of each switch A2 is connected in series to each other by means of a copper wire A6 and to one end A31 of an overload protector A3 the other end A32 of the overload protector A3 is connected to the incoming electric power source, the connecting points A22 of the switch A2 are connected by separate copper wire A5 and connected to the connecting point A11, the groundings A23 from the second switch A2 and thereafter, are connected to the groundings A12 of each receptacle molding A1, and the grounding of the first switch A1 is connected to the groundings A12 of the receptacle molding A1 by another copper wire A4 which is also connected to the grounding of an incoming power circuit., this design has some shortcomings one is that the soldering has to be perfect, if any parts loosen, the switch box will be short circuit.

SUMMARY OF THE INVENTION

It is the primary object of the present invention to provide an integral multi-switch which is more reliable.

It is another object of the present invention to provide a multi-switch receptacle which uses no soldering, and saves manufacturing cost.

It is a further object of the present invention to provide an integral multi-switch which is easy to operate.

DETAILED DESCRIPTION OF THE PREFERRED EMBODIMENTS

Figure 1:
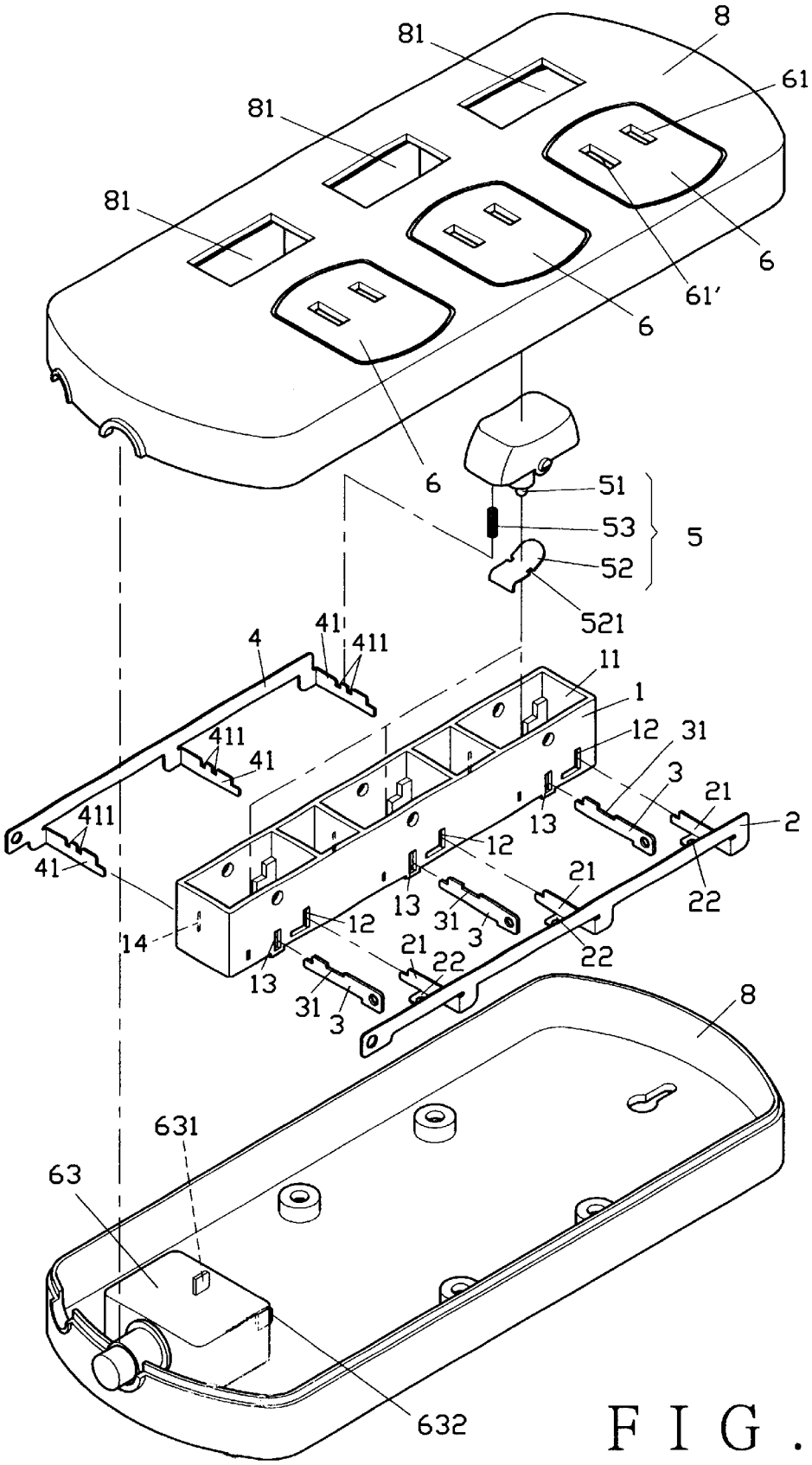
FIG. 1 is an exploded view of the present invention.

An integral multi-switch of the present invention, as shown in FIG. 1, comprises a switch box 1, conducting plates, 2, 3 and 4, switch 5, receptacle molding 6 and case 8.

The switch box 1 is a rectangular hollow case with several isolated troughs 11 in the hollow body, each trough 11 has a first, a second and a third conducting troughs 12, 13 and 14.

The first conducting plate 2 is an integral plate to conduct electric power, the plates corresponds to each trough 11 has formed with several long side plates 21, each of which has extended a short side plate 22 inwardly, the second conducting plate 3 is for electric power output and is in isolated pieces, each piece has a notch 31 at its top edge, the third conducting plate 4 is also integral and is a grounding terminal which has extending a locator 41 vertically with a notch 411 on the edge, and is corresponding to the trough 11.

The switch 5 which is a known prior art, and will not be described hereinafter, has a conductive post 51 (having one end connected to the indicative light through a spring), and spring 53, the post 51 presses a spring plate 53 to control the circuit in open or closed status. The spring plate 53 has a pair of holes 521 at respective sides.

Figure 2:
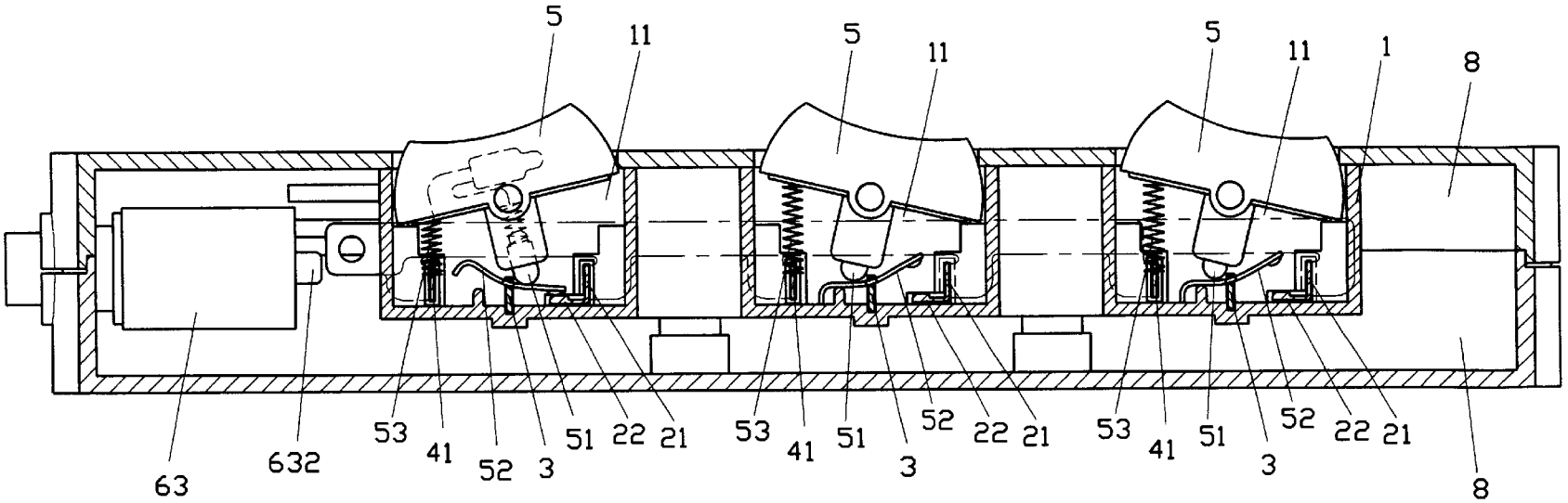
FIG. 2 is a side perspective view of the present invention, partially sectioned.
Figure 3:
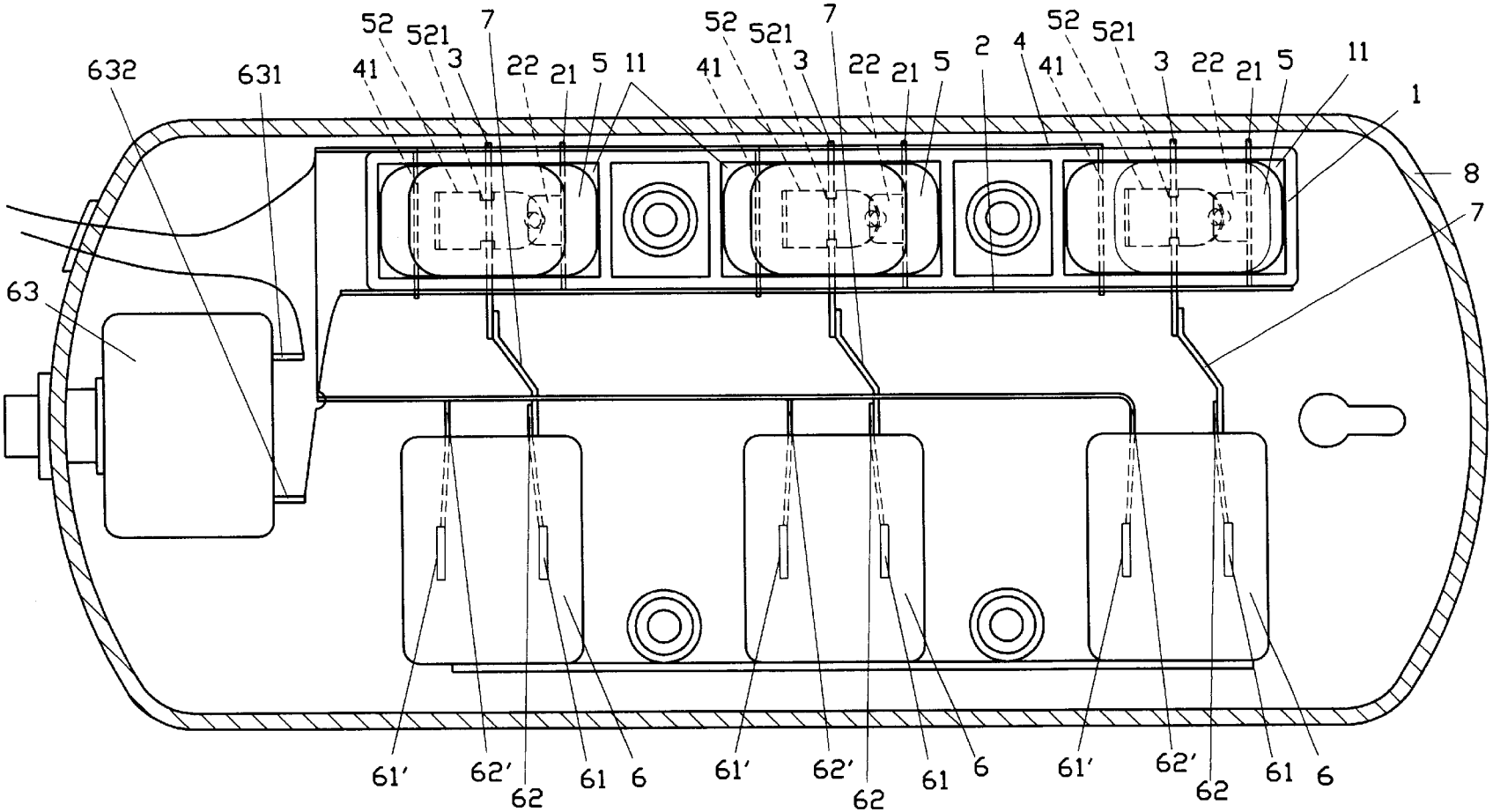
FIG. 3 is a top perspective view of the present invention, partially sectioned.

The receptacle molding 6 which is also a known art, corresponds in number to the trough 11 of the box 1, please refer to FIG. 3, all receptacle moldings 6 are mounted on a case 8, and each receptacle molding 6 comprises at least two holes 61 and 61' which are extending a pair of wires 62 and 62', with one wire 62 connected to the positive end of the electric power, while wire 62' is grounded, respectively To assemble, please refer to FIGS. 2 and 3, insert the long side plates 21 of the first conducting plate 2 and the locator 41 of the third conducting plate 4 into the first and the third conducting troughs 12 and 14, respectively. This leads the first and the third conducting plates 2 and 4 closed to the outer edge of the switch box 1, insert the second conducting plate 3 into the second trough 13, thus the short side plate 22, the locator 41 and the second conducting plate 3 are the switch point, wherein the short side plate 22 is the first electric power end, the second conducting plate 3 is the second electric power end and the locator 41 is grounded. Secure the holes 521 of the spring plate 52 to the notch 31 of the second conducting plate 3, so that the second conducting plate 3 is always in contact. Secured the switch 5 to the top portion of the trough 11 of the switch box 1 with the post 51 at its bottom end engages with the spring plate 52, so as to control the spring plate 52 to be engages or disengages with the short side plate 22 of the first conducting plate 2, as a switch to turn the power ON/OFF. Since the first conducting plate 2 and the third conducting plate 4 are all in one piece, a one time installation solves all problems.

Upon mounting the switch box 1 into the case 8, each switch 5 exposed from an individual hole 81, as shown in FIG. 3, the conducting plate 62 of the receptacle molding 6 and the second conducting plate 3 are connected by a copper wire 7, whereas the conducting plate 62' is connected to the third conducting plate 4, the first conducting plate 2 is connected to the incoming power that forms the entire circuit, (an overload protector may be connected in series).

Figure 4:
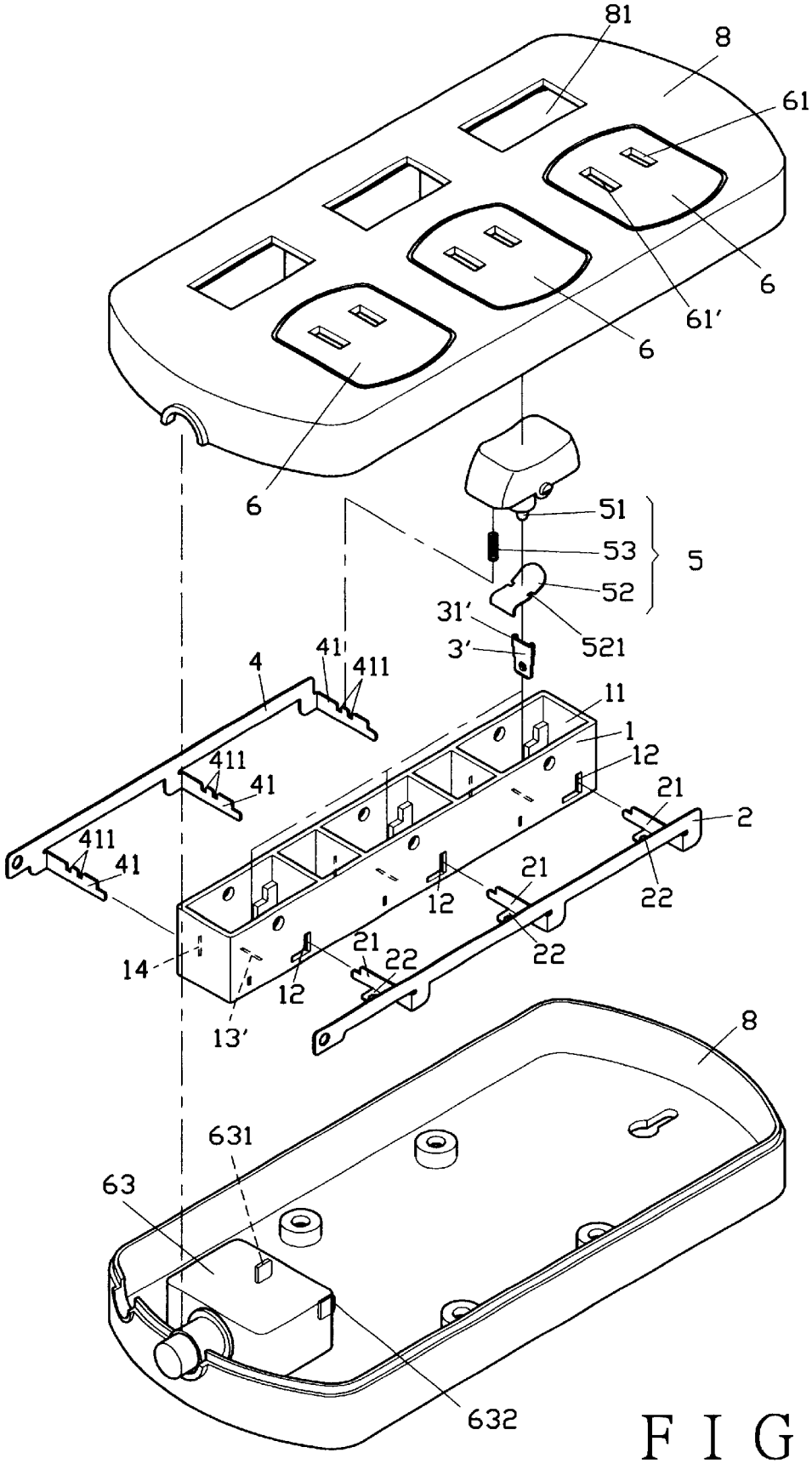
FIG. 4 is an exploded view of a first embodiment of the present invention.
Figure 5:
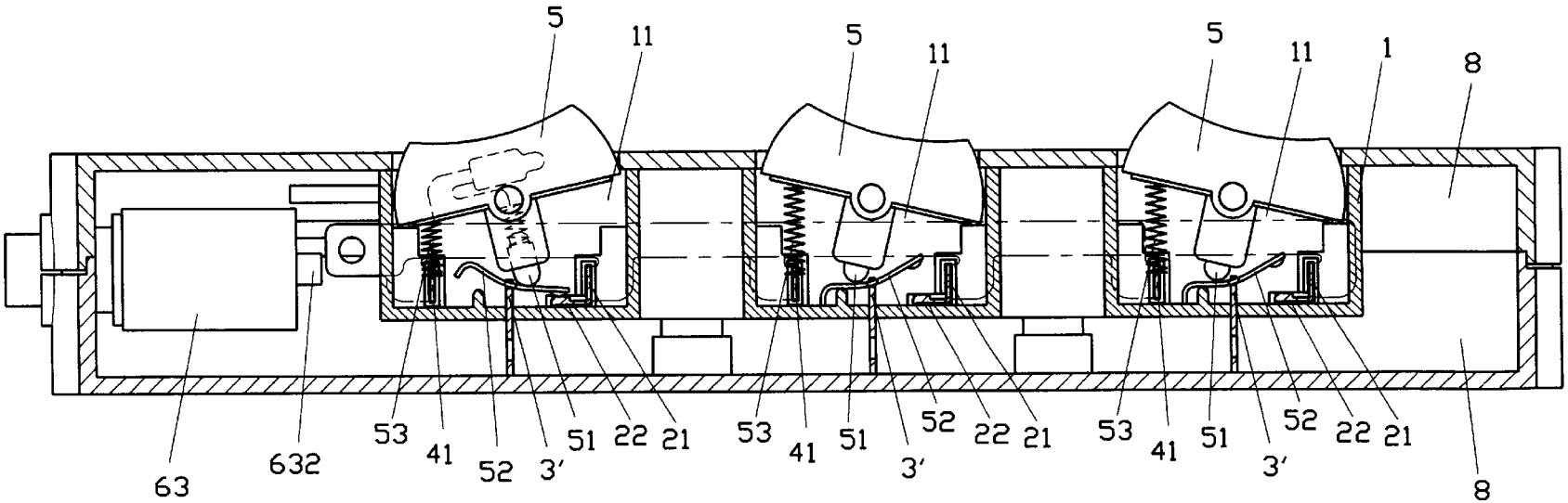
FIG. 5 is a perspective view of FIG. 4, partially sectioned.

A second embodiment of the present invention is shown in FIG. 4 which has the second conducting plate 3' formed in a vertical shape and has a notch 31' at top end, thus when the second conducting plate 3' placed in the second trough 13', it stands as a support to the spring plate 52, as shown in FIG. 5.

Figure 6:
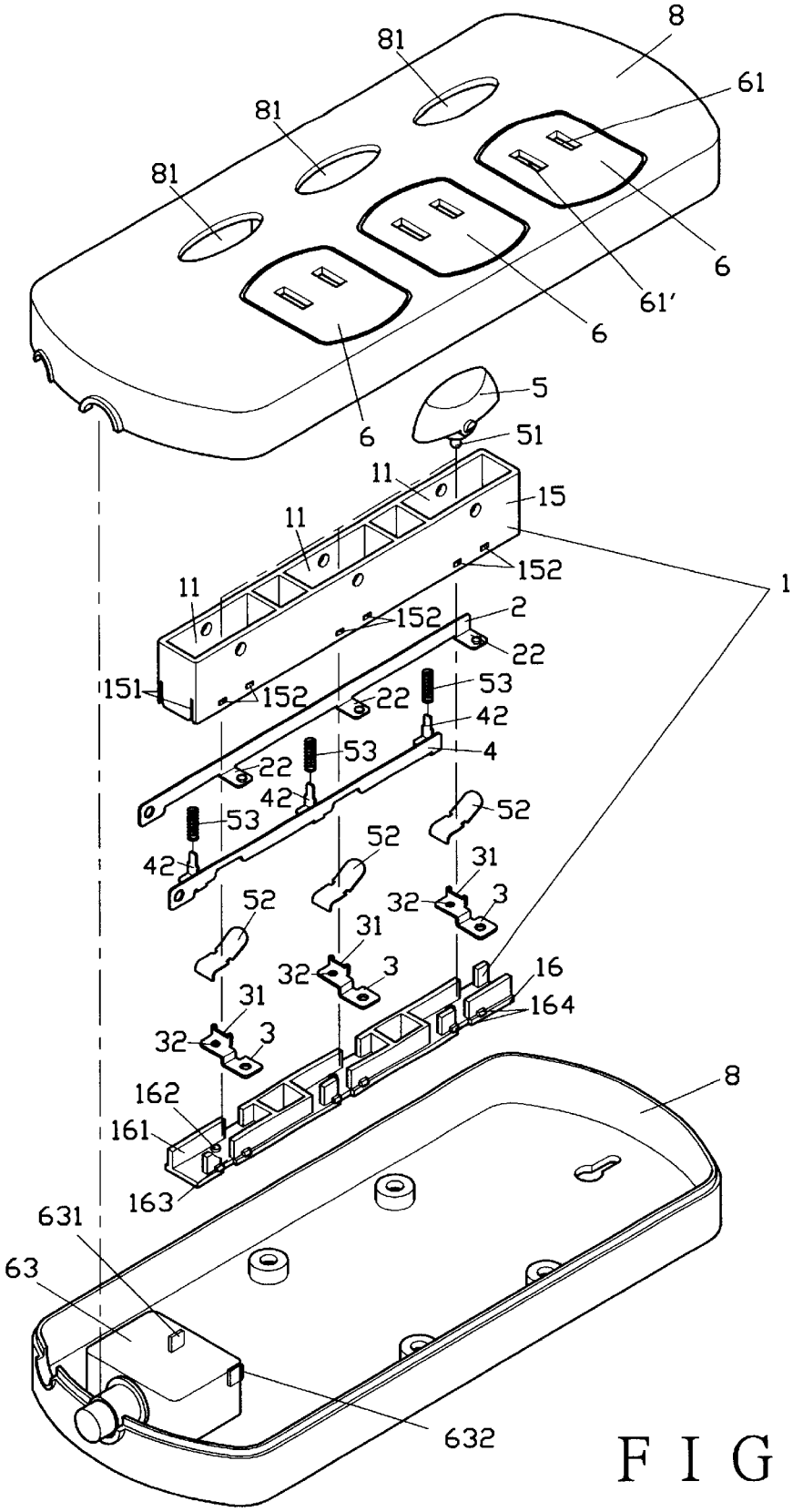
FIG. 6 is an exploded view of a second embodiment of the present invention.
Figure 7:
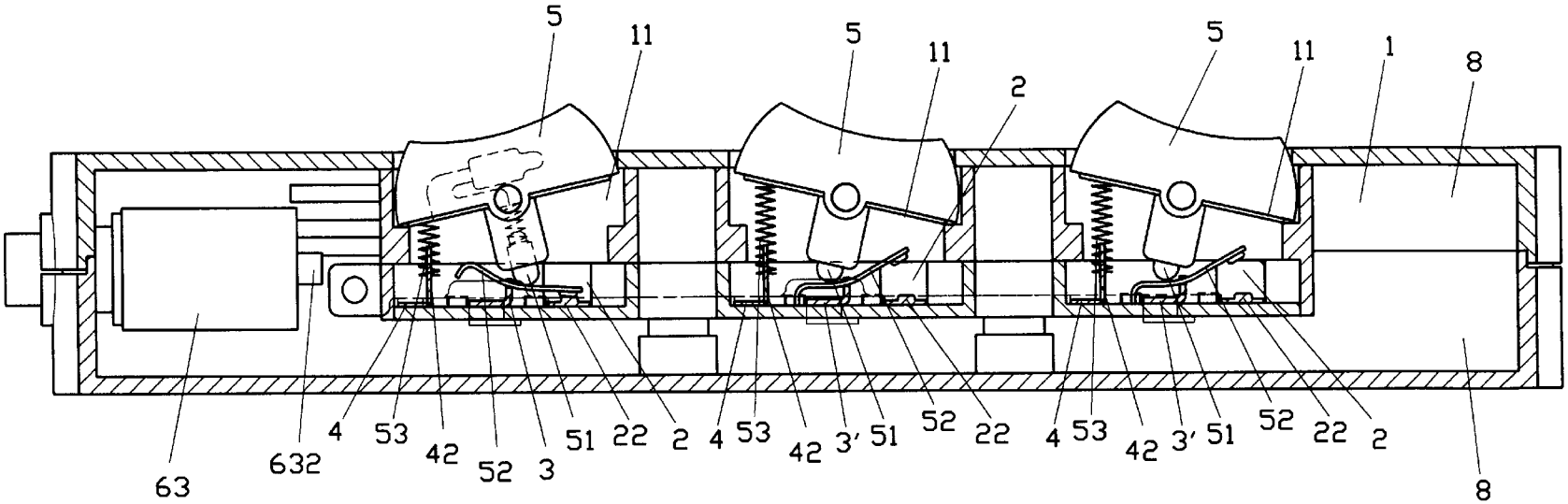
FIG. 7 is a perspective view of FIG. 6, partially sectioned.

A third embodiment is shown in FIG. 6 in which switch box 1 is formed by a trough seat 15 and a lower cap 16 separate from each other. The trough seat 15 has at least two troughs 11, the lower cap 16 is a flat plate with its two sides rising upward in a 90 degrees angle to form two ribs 161 which have plural protuberances 162 extending inwardly, and a number of gaps 163 on the rib and equally spaced from the protuberances 162. The lower cap 16 has a locating ridge 164 at a side edge. The trough seat 15 has one end formed with two slots 151 corresponding to each other, the respective sides corresponding to the locating ridge 164 are formed with locating holes 152, the first conducting plate 2 being in a one piece form with plural short side plates 22 extending from the plate edge in a horizontal direction and corresponding to the trough, the second conducting plate 3 being formed by a number of plates, each plate having a hole 32, the third conducting plate 4 being formed as an integral plate having a number of ribs 42 extending upwardly corresponding to the troughs 11.

To assemble, insert the first conducting plate 2 and a third conducting plate 4 through the gaps 163 of the rib 161 of the lower cap 16. The second conducting plate 3 is secured by inserting the protuberances 162 of the lower cap 16 into the hole 32, and inserting the lower cap 16 from the bottom upwards into the trough 15, with the locating ridge 164 inserting in the locating hole 152. Thus, the lower cap 16 is secured to the trough seat 15, and the first conducting plate 2 and the third conducting plate 4 are inserted with one end through the slot 151 and extending outward. The second conducting plates 3 and the spring plates 52 will be seating in the trough seats 15 along with the lower cap 16. Place the switch 5 on the trough 11 with the post 51 engaging the spring plate 52 which is supported by the second conducting plate 3 to be driven by the post 51 to engage or disengage with the short side plate 22 of the first conducting plate 2.

Figure 8:
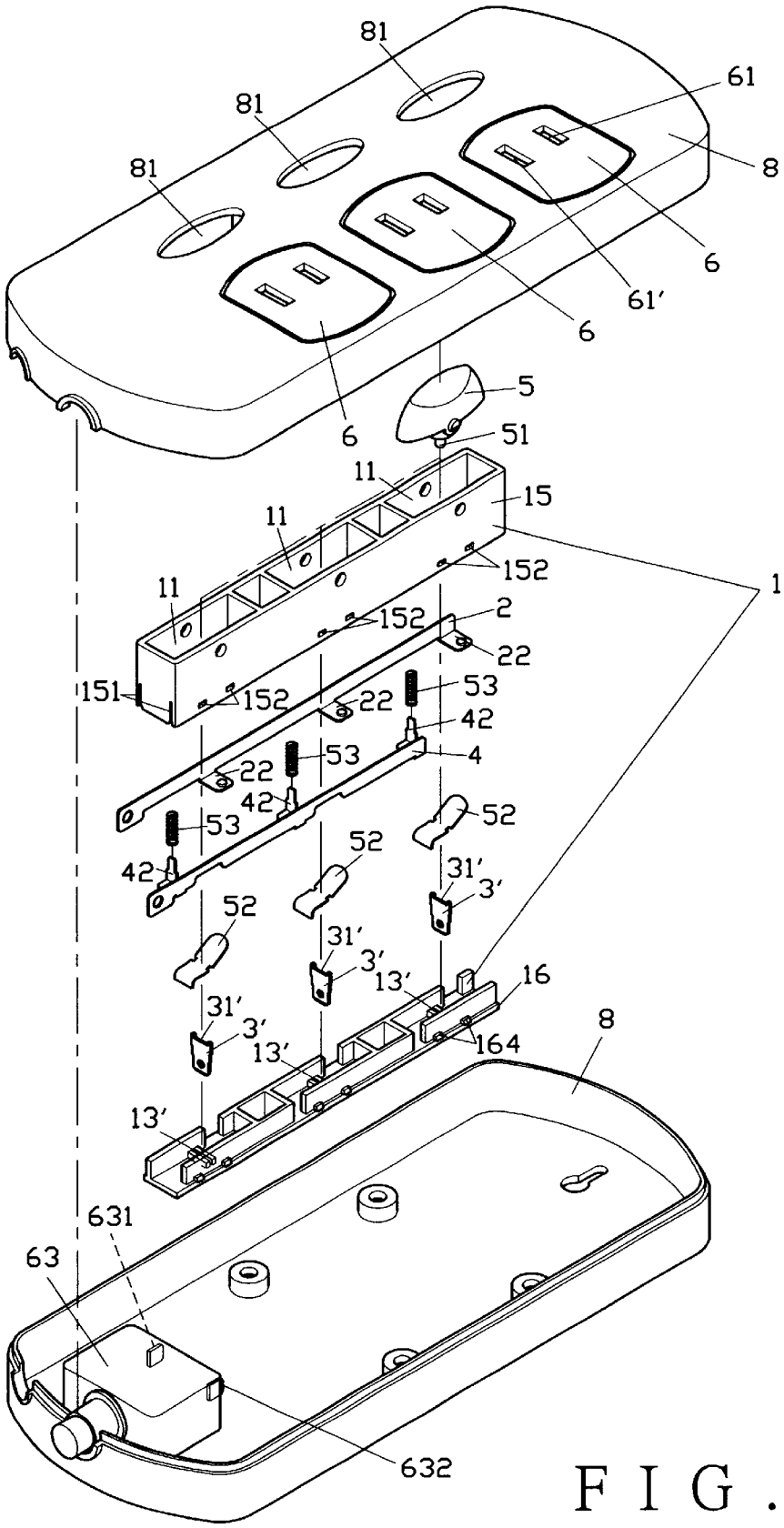
FIG. 8 is an exploded view of a third embodiment of the present invention.

A third embodiment of the present invention, as shown in FIG. 8 is to have the second conducting plate 3' formed with several vertical pieces, with notch 31' on top of each plate 3' for receiving a corresponding spring plate 52 thereon. The lower cap 16 has a pair of second conducting plates 13'. When assembling, place the first and the third conducting plates 2 and 4 on the two ridges of the lower cap 16, and the second conducting plate 3 inserted into the second conducting plates 13'. When closing the lower cap 16 to the trough seat 15, the first conducting plate 2, the third conducting plate 4, and the second conducting plates 13' in the lower cap 16 are seating in the trough seat 15, wherein the short side plate 22 of the first conducting plate 2 and the ribs 42 of the second and the third conducting plates are seating in the trough 11 and forming contact points controlled by the switch 5.

Figure 9:
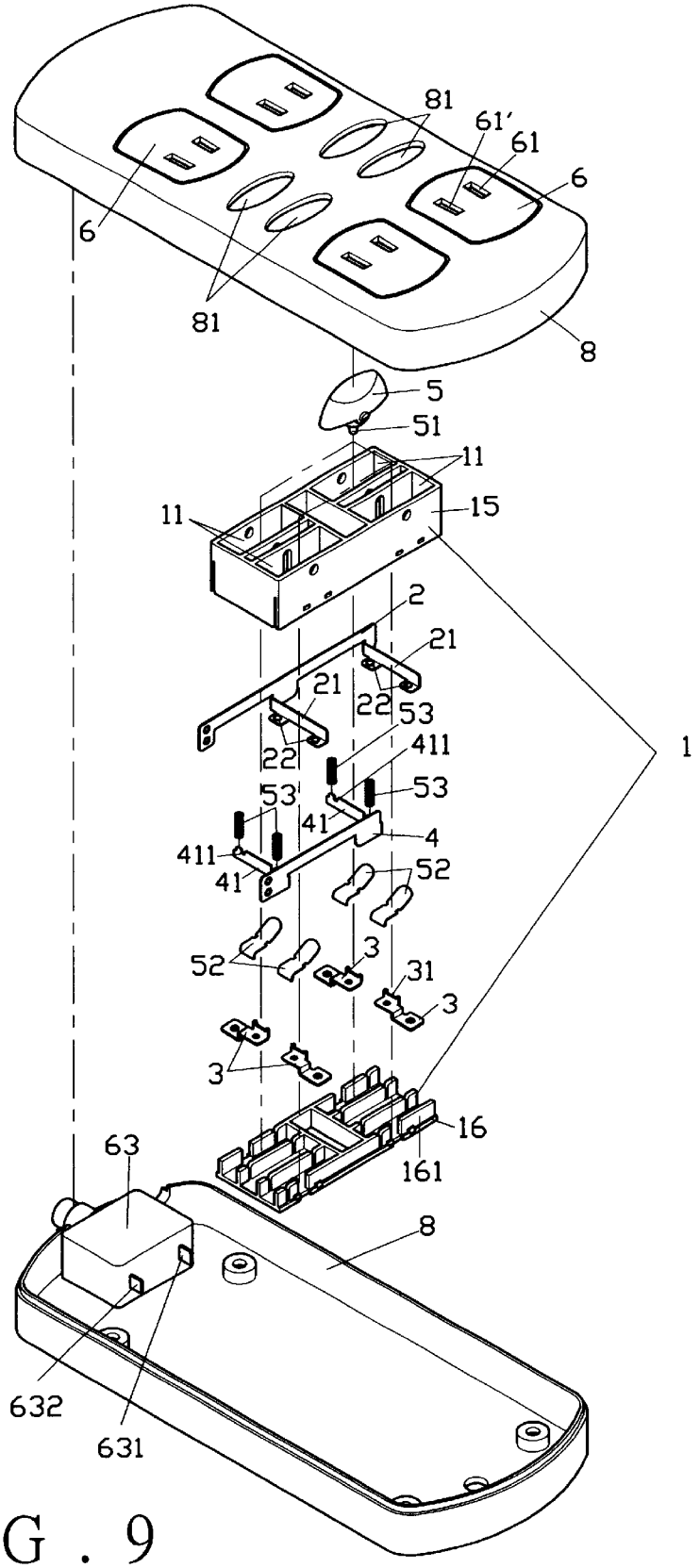
FIG. 9 is an exploded view of a fourth embodiment of the present invention.
Figure 10:
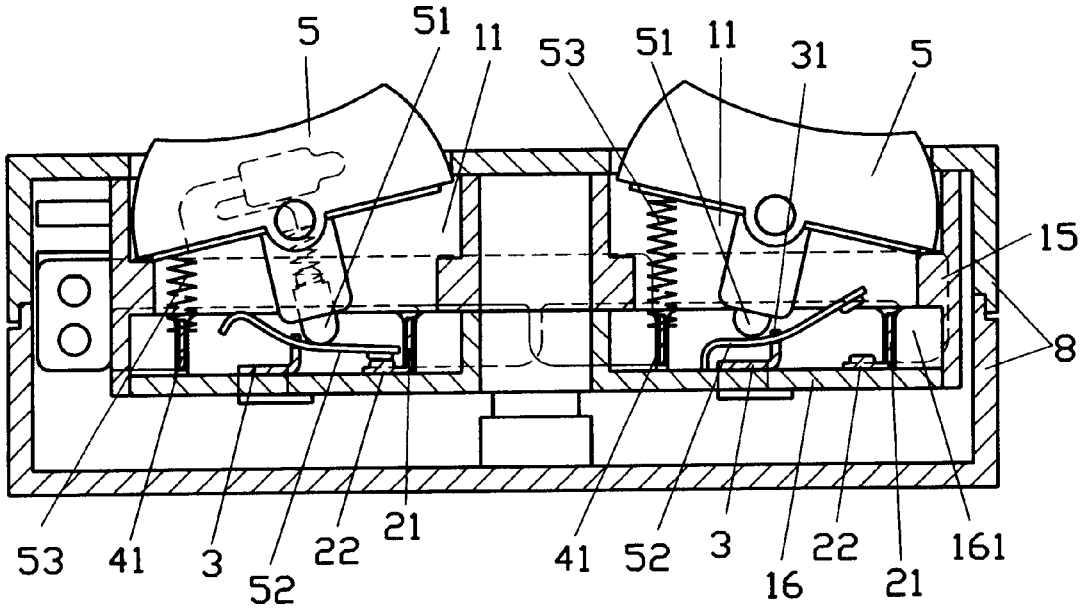
FIG. 10 is a perspective view of FIG. 9, partially sectioned.

Other than the vertical trough 11, there are horizontal direction designs, as shown in FIG. 9 in which switch box 1 is formed with the trough seat 15 and the lower cap 16. The trough seat 15 is able to receive at least two troughs 11, and the first conducting plate 2 is integrally formed. The plate 2 has a number of long side plates 21 corresponding to the trough 11, and each long side plate 21 has extending therefrom a number of short side plates 22 with contact points thereon. The second conducting plate 3 is formed by a number of plates, each plate having a notch 31 at the top. The third conducting plate 4 is also formed integrally in one piece with a number of locators 41 corresponding to the trough 11, each locator having a notch 411 on top for receiving the spring 53. The lower cap 16 has a number of ribs 161 to secure the first, the third, and the fourth conducting plates 2, 3, and 4. To assemble, secure the first, the third, and the fourth conducting plates 2, 3, and 4 to the lower cap 16, as shown in FIG. 10 and place the spring plates 52 on the dents 31 of the second conductive plate 3. Thus, when connecting the lower cap 16 to the trough seat 15, the spring plates 52 are controlled by the switches 5.

Figure 11:
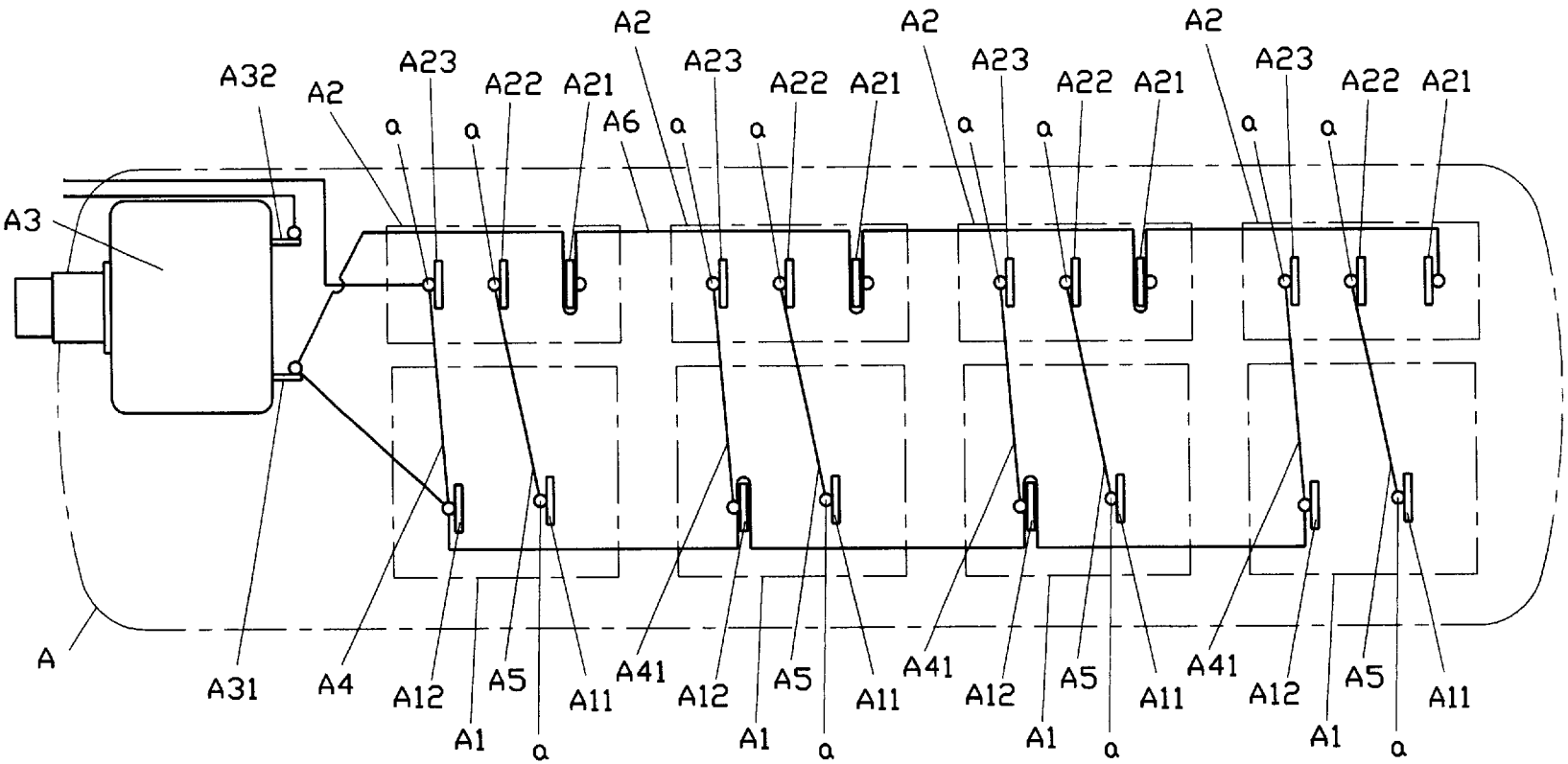
FIG. 11 is a top sectional view of a prior receptacle.
Figure 12:
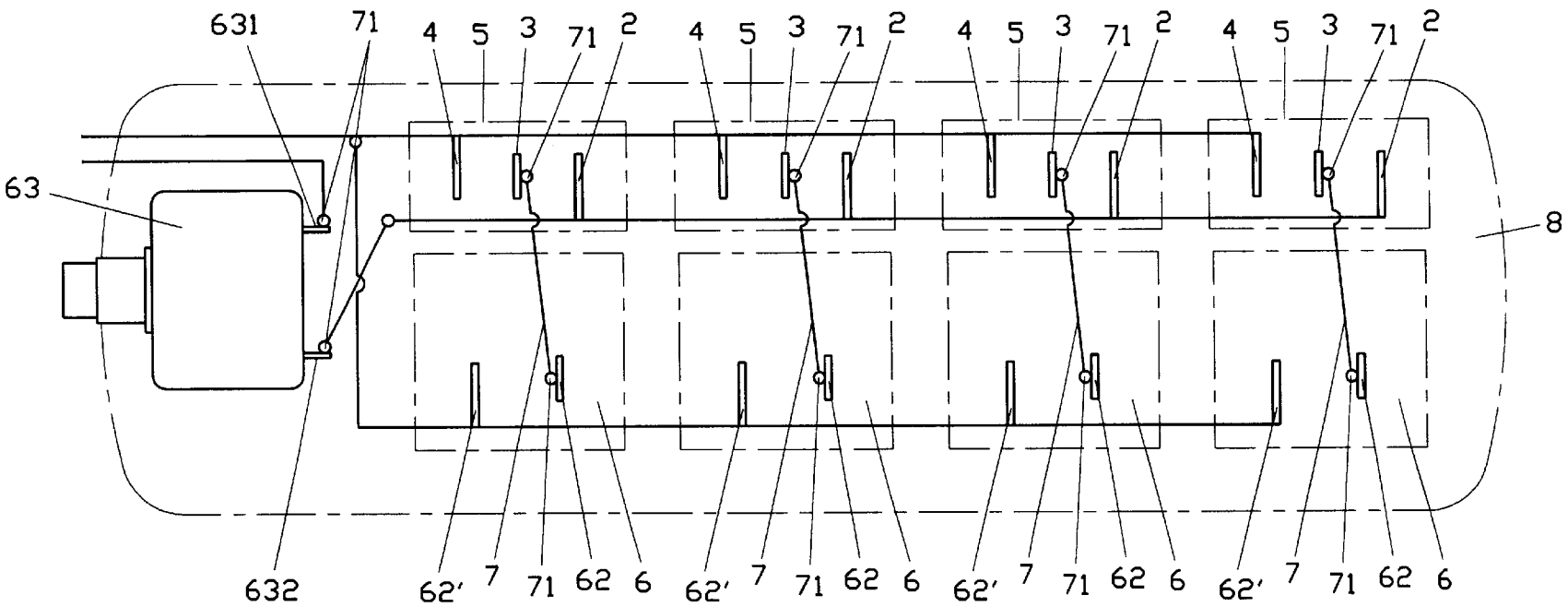
FIG. 12 is a top sectional view of the present invention.

FIGS. 11 and 12 have shown the contact points of a prior art and the present invention, wherein the contact points A21 and A22 of the switch A2, and the receptacle molding A1 and the grounding contact point A23 are connected by copper wire A6, A4, A41, and A5, and are soldered at each contact point "a" disregards the overload protector A3 and incoming grounding. The switch A2 and the receptacle molding A1 have more than 20 soldering points which increase by 20 times the number of bad connections, whereas the grounding 62' of the receptacle 6 and the first and the third conducting plates 2 and 4 of this invention utilizes integrally formed, one-piece modules, such that the soldering points are limited to the conducting plate 62 of the receptacle 6 and the conducting plate 3 of the switch box.

Figure 13:
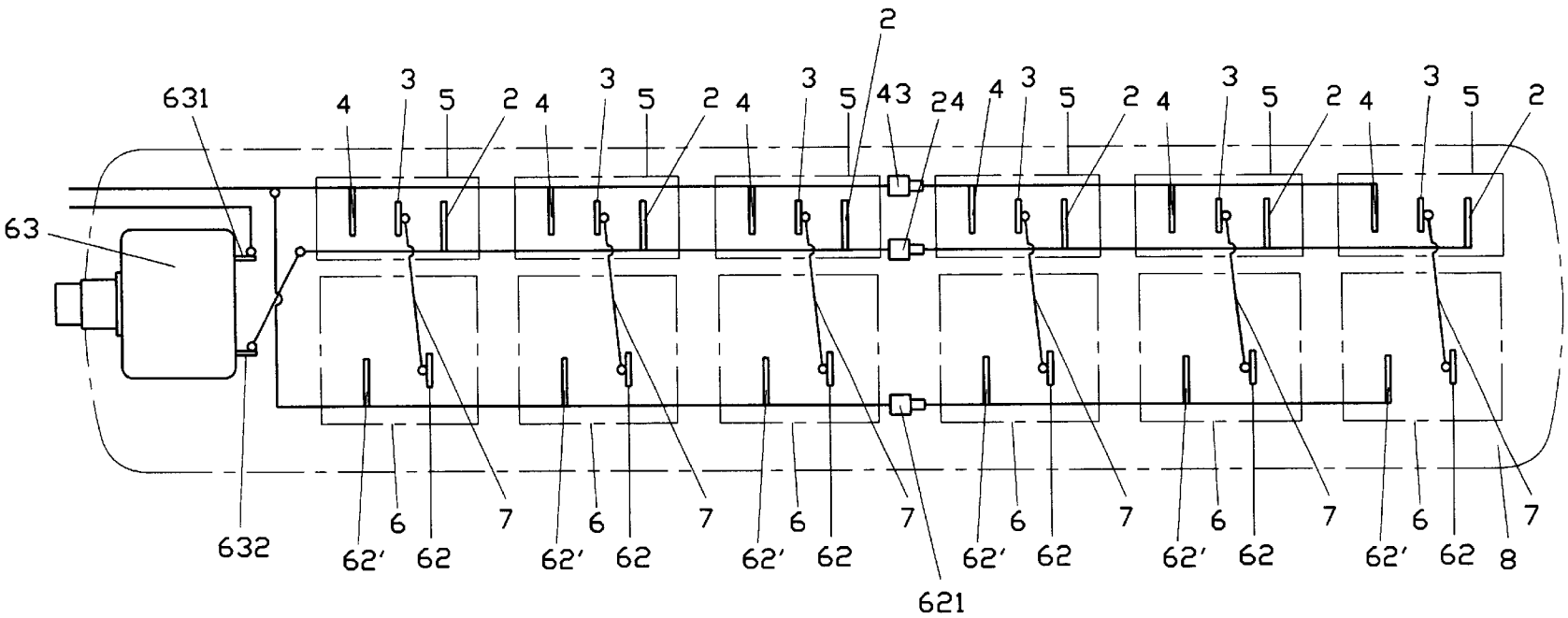
FIG. 13 is a top sectional view of the fifth embodiment of the present invention.
Figure 14:
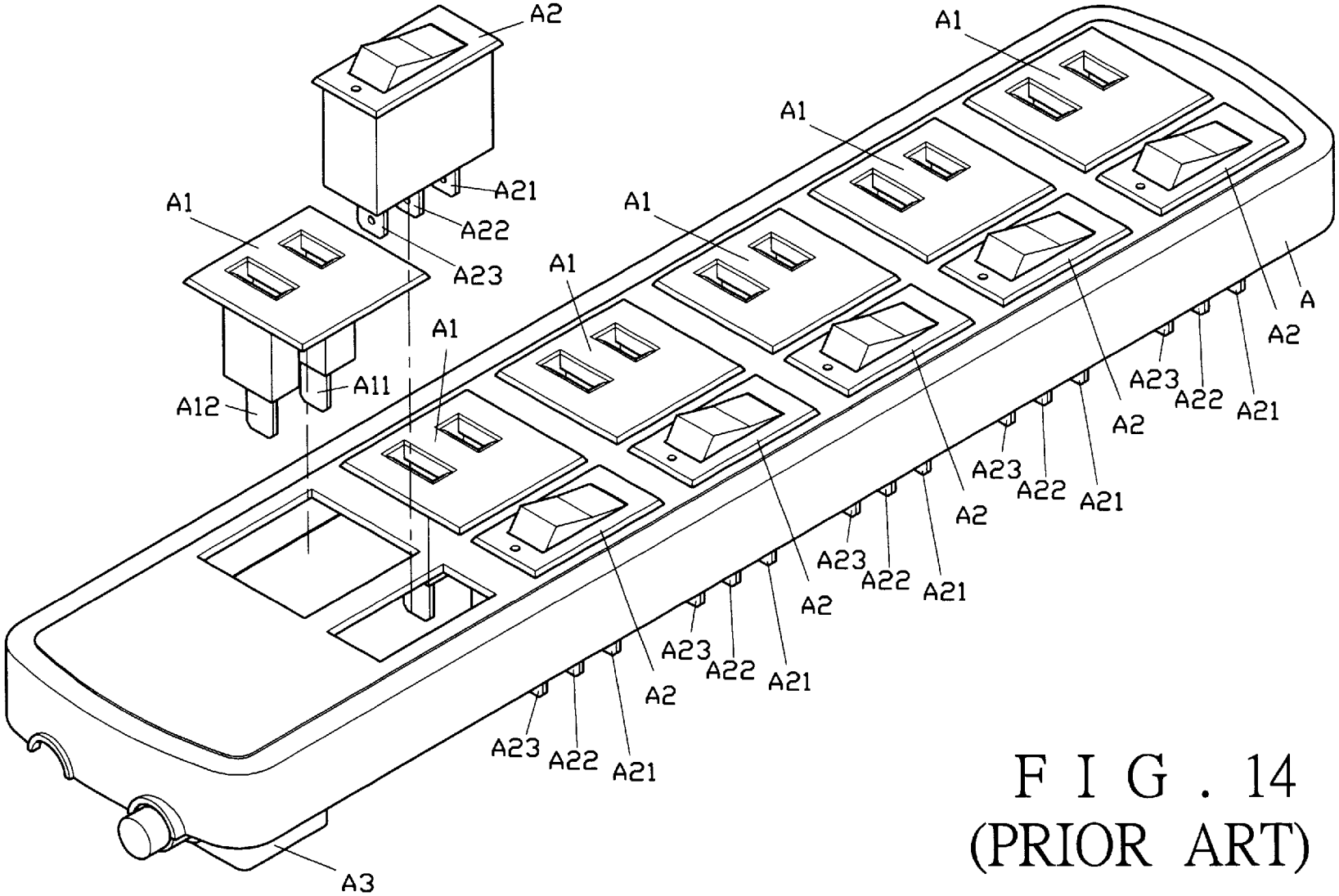
FIG. 14 (PRIOR ART)
FIG. 14 is a top perspective view of the prior art multi switch box.
Figure 15:
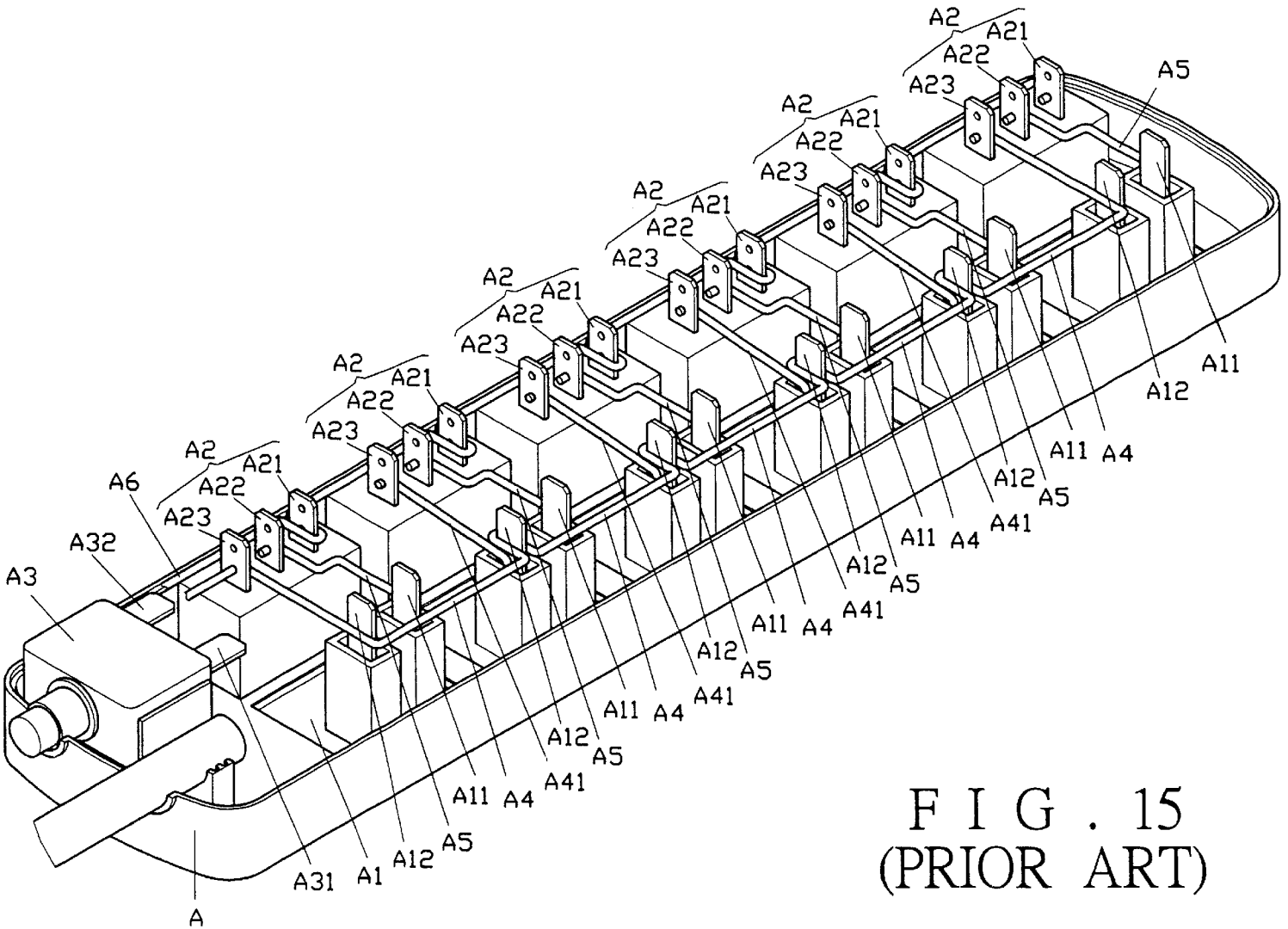
FIG. 15 (PRIOR ART)
FIG. 15 is a bottom perspective of the prior art multi switch box.

A fifth embodiment, as shown in FIG. 13, has depicted the first conducting plates 2 and the third conducting plates 4 been formed with male and female hooks, 24 and 43 that correspond to each other, the male and female hooks 24 and 43 may be in barrel shape, in post shape, or in hook shape, and may be formed as much or less as possible in corresponding to the switch box 1. For instance, if a six sets of receptacle moldings 6 are adapted, two sets of switch box 1 with three switches 5 are matching with the male and female hooks 24 and 43 of the first and the third conducting plates 2 and 4, to form a switch box 1 with six switches 5. Whereas, the conducting plate 62 of the receptacle molding 6 has also formed with a hook 621 which is connected to a corresponding hook 621 of the conducting plate 62' of the receptacle molding 6, the present invention has also introduced extending sleeves on the ends of the first conducting plates 2, the third conducting plates 4 and the conducting plate 62'.

The switch box 1 of the above design includes the first, second and third conducting plates 2, 3 and 4, wherein the third conducting plate 4 is to control illumination of the indicator in the switch 5. If there is no require to use the indication, the third conducting plate 4 may be eliminated, likewise, it is capable of built a fourth or more conducting plate in an integral one piece or in several independent pieces, as required.

The switch box 1 of this invention is lined up in series, and comprises at least two or more troughs 11. Each trough 11 may be lined up in series or in parallel or even in a circling arrangement. This multi-trough structure facilitates the installation procedure and minimizes the number of required soldering spots. If the conducting plates are not in one piece, then a pre-soldering will also save time of installation later on. Further, the case 8 may be formed integrally, in one piece to save more time.

Figure 16:
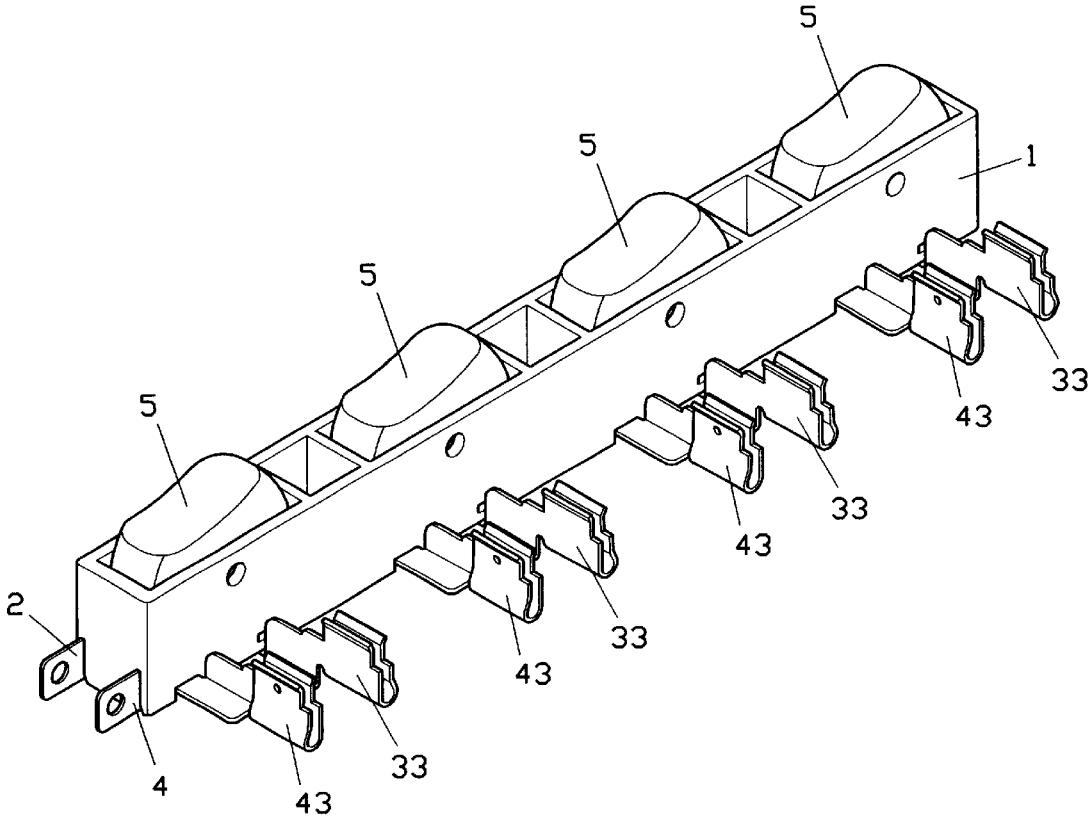
FIG. 16 is a perspective view of a sixth embodiment of the present invention.
Figure 17:
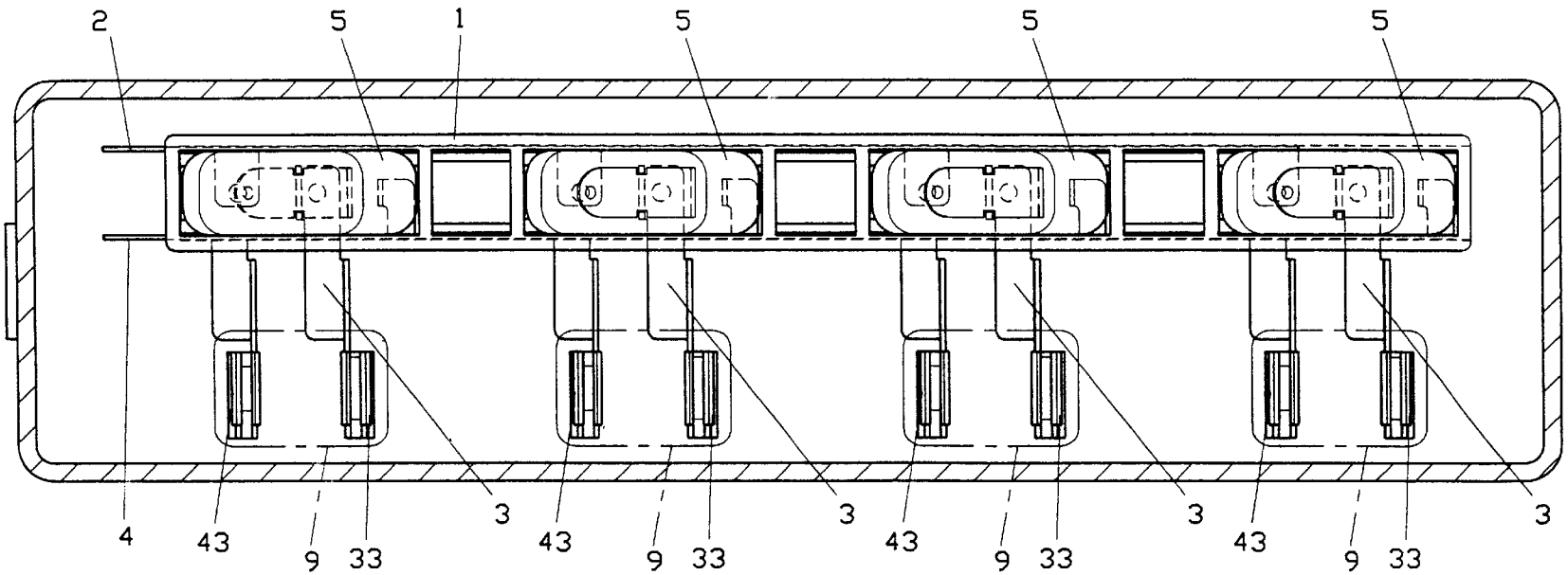
FIG. 17 is a top sectional view of a seventh embodiment of the present invention, partially sectioned.

A non-soldering multi-switch box is derived from the above mentioned structure, as shown in FIGS. 16 and 17, the second conducting plate 3 and the third conducting plate 4 are both extending outwards to form second clips 33 and third clips 43, the second clips 33 connect to the positive end while the third clips 43 are grounded connection. Each clip 33 and 43 are so formed by bending to a U-shaped which correspond to the terminal of a plug, it is to be noted the shape is not limited to U-shape, any other shape, such as single plate, is fisible so long as they are capable of contact with the terminal of the plug. In this example, each clip 33 or 43 is formed with no soldering spot.

Figure 18:
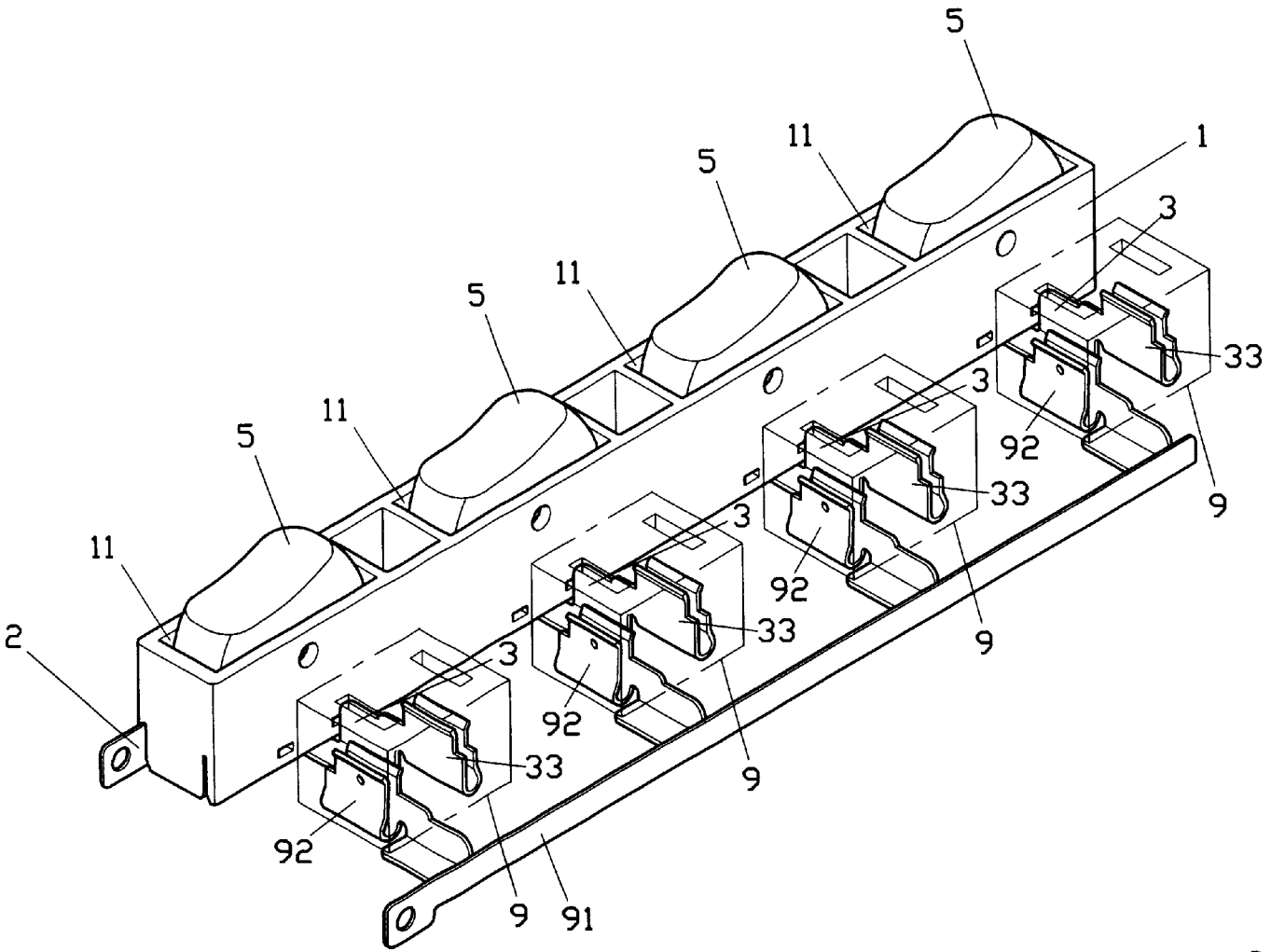
FIG. 18 is a perspective view of the seventh embodiment of the present invention, partially sectioned.

FIG. 18 has shown a further design which uses no indicator in the switch 5 and has only two contact points in each trough 11, one contact point is formed by the first conducting plate 2, and the other is formed by the second conducting plate 3. The grounding connection of the third conducting plate 4 is not included in this. Each second conducting plate 3 of the switch box 1 has extending outward to form the second clip 33 which is connected to the positive terminal of the plug 9, and the negative terminal of the plug 9 is a one piece plate 91 which has extending a clip 92 which corresponds to the clip 33 of the second conducting plate 3 and form a contact point.

Figure 19:
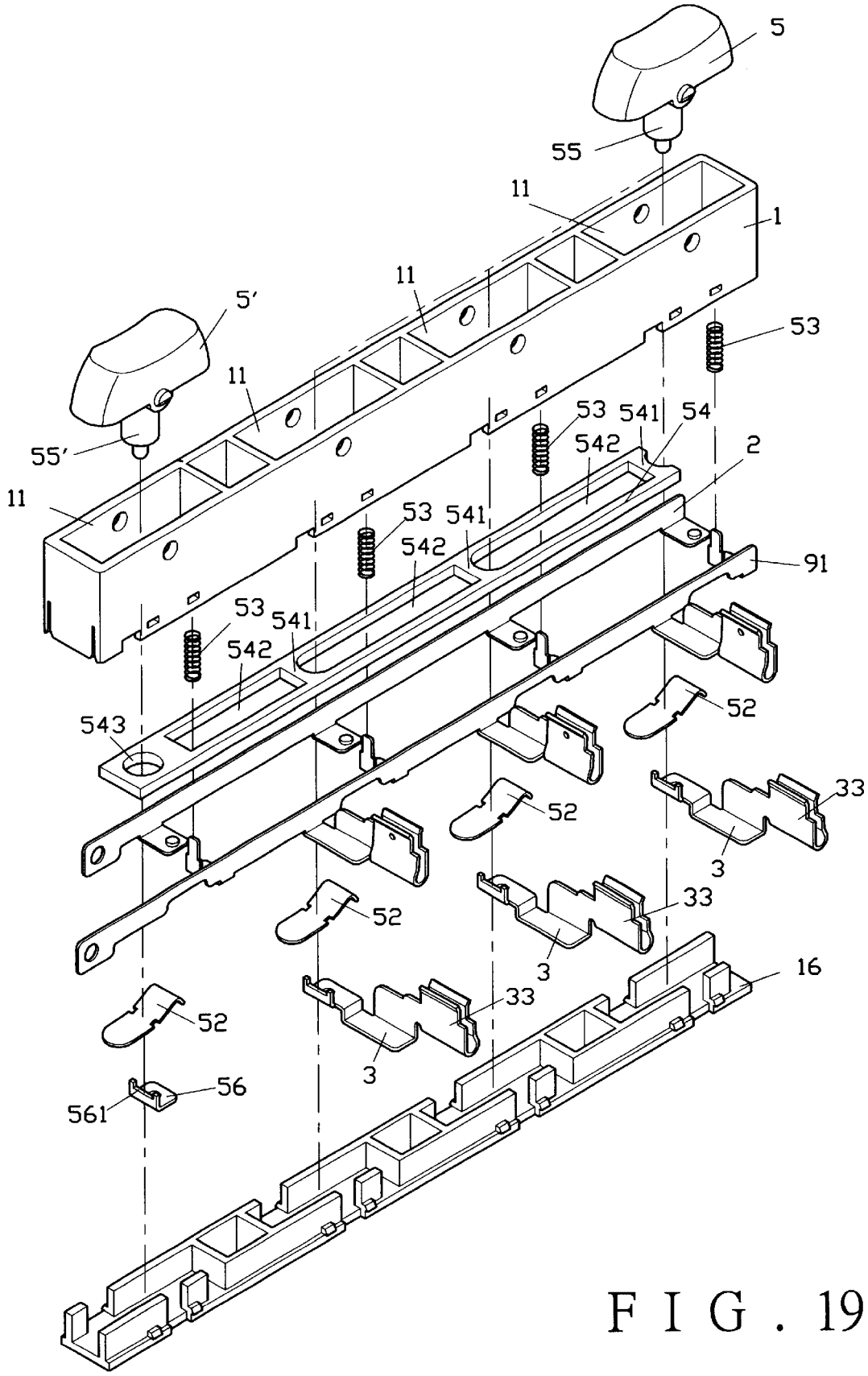
FIG. 19 is an exploded view of an eighth embodiment of the present invention.
Figure 20:
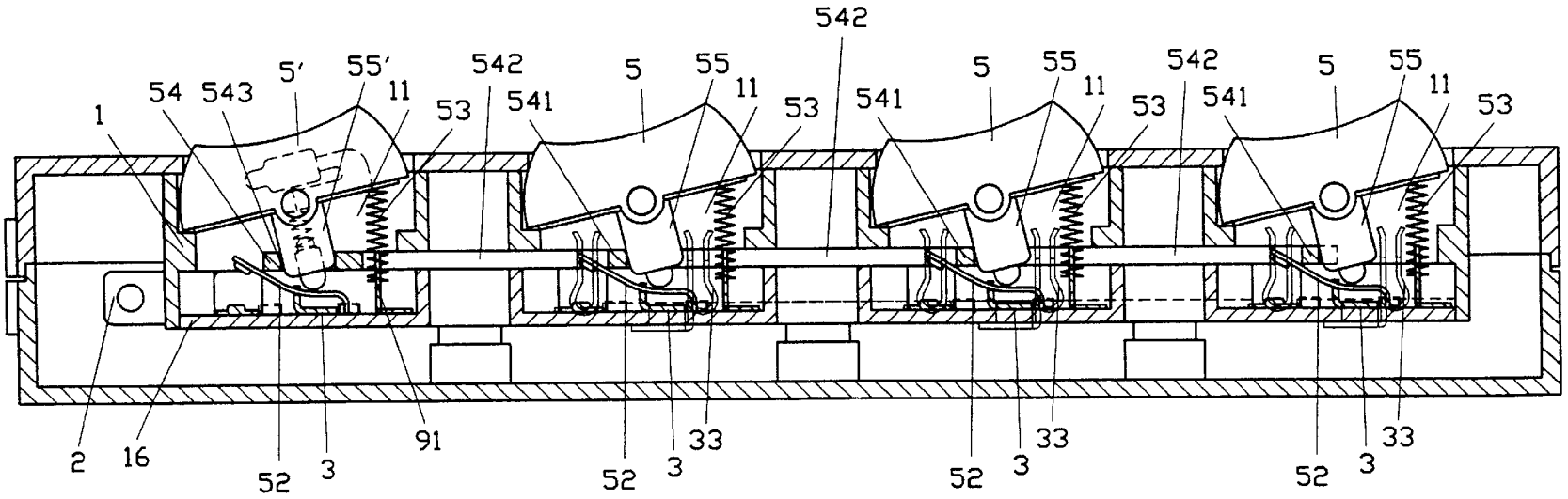
FIG. 20 is a side perspective view of the eighth of the present invention, partially sectioned.
Figure 21:
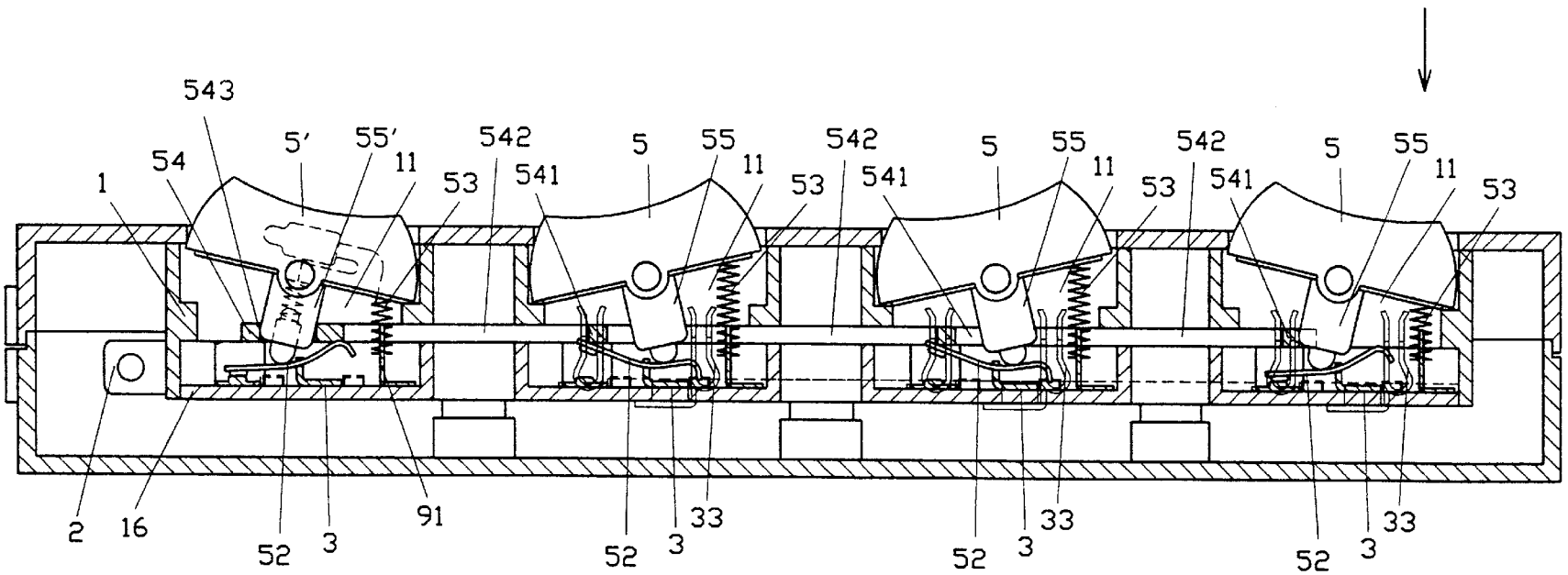
FIG. 21 is a side perspective sectional view of the eighth of the present invention, in operation.

FIG. 19 has shown a further embodiment which uses a special switch 5' to turn the power on and off. This design is to place a push plate 54 in each of the switch 5 and 5', a number of push block 541 are equally located in between the push plate 54, each push block 541 has an open space at one side and a hole 543 at one end thereof, corresponding to the hole 543, the switch box 1 has a support 56 at its end with a notch 561 at the top portion. To assemble, insert the posts 55' at the bottom end of the switch 5' through the hole 543 of the push block 54, as shown in FIG. 20 and controlled by the push plate 54 to go forward and rearward. In practice, when any of the switch 5 is pushed and conducted, as shown in FIG. 21, the post 55 of the switch 5 pushes the push block 541 of the push plate 54 to slide, thus the hole 543 of the push plate 54 is driven to push the special switch 5' to a conducting status. The indicator built within the special switch 5' will light up at this time. The post 55 of the switch 5 is free to move in the open space or the push plate 54, thus any other switch 5 will not affect the particular switch 5 however, when pressing the special switch 5' to shut down the power, the post 55' will push the push plate 54 to slide horizontally which then brings the push blocks 541 to push the posts 55 of all turned on switches 5 to off status.

If the push plate 54 is installed in reverse, the simultaneous turned off design of the switches will be changed to simultaneous turned on, or if a twin push plates are installed and are in reverse direction, the switches 5 can be turned on and off simultaneously.

I claim:

1. An integral multi-switch assembly comprising:

(a) a plurality of electric receptacle devices;

(b) a switch box having a plurality of troughs defined therein;

(c) a first conducting plate coupled to said switch box, said first conducting plate being integrally formed to include a longitudinally extended portion, a plurality of long side plate portions projecting transversely therefrom, said long side portions being spaced longitudinally one from the other, each said long side portion extending into one of said troughs;

(d) a plurality of second conducting plates each electrically connected to one of said electric receptacle devices, each said second conducting plate being coupled to said switch box to extend into one of said troughs;

(e) a third conducting plate coupled to said switch box, said third conducting plate being integrally formed to include a longitudinally extended portion with a plurality of locator portions projecting transversely therefrom, said locator portions being spaced longitudinally one from the other, each said locator portion extending into one of said troughs; and, (f) a plurality of switch devices each coupled to one of said second conducting plates, each said switch device being selectively actuable between at least two states, said switch device in one said state electrically coupling said second conducting plate to said first conducting plate and in the other said state electrically decoupling said second conducting plate from said first conducting plate.

2. The integral multi-switch assembly as recited in claim 1 wherein said first conducting plate includes at least one hook portion formed thereon.

3. The integral multi-switch assembly as recited in claim 1 wherein each of said first and third conducting plates includes at least one hook portion formed thereon.

4. An integral multi-switch assembly comprising:

(a) a plurality of electric receptacle devices;

(b) a switch box having a plurality of troughs defined therein;

(c) a first conducting plate coupled to said switch box, said first conducting plate being integrally formed to include a longitudinally extended portion a plurality of transverse portions projecting therefrom to extend into one of said troughs;

(d) a plurality of second conducting plates each electrically connected to one of said electric receptacle devices, each said second conducting plate being coupled to said switch box to extend into one of said troughs;

(e) a plurality of switch devices each coupled to one of said second conducting plates, each said switch device being selectively actuable between at least first and second states, said switch device in said first state electrically coupling said second conducting plate to said first conducting plate and in said second state electrically decoupling said second conducting plate from said first conducting plate; and, (f) a push plate disposed in said switch box engaging at least a first of said switch devices, said push plate being displaceable to correspondingly actuate the others of said switch devices to said first states thereof responsive to actuation of said first switch device to said first state, said push plate being reversibly displaceable to correspondingly actuate said first switch device to said second state thereof responsive to actuation of a second of said switch devices to said second state.

5. The integral multi-switch assembly as recited in claim 4 wherein said push plate is longitudinally extended between first and second ends, said first end having formed therein a through hole engaging said first switch device, said second end longitudinally abutting said second switch device.

6. An integral multi-switch assembly comprising:

(a) a plurality of electric receptacle devices;

(b) a switch box having a plurality of troughs defined therein;

(c) a first conducting plate coupled to said switch box, said first conducting plate being integrally formed to include a longitudinally extended portion a plurality of transverse portions projecting therefrom to extend into one of said troughs;

(d) a plurality of second conducting plates each forming a portion of one said electric receptacle device, each said second conducting plate being coupled to said switch box to extend into one of said troughs, each said conducting plate including a clip portion disposed outside said switch box to form an electric plug receiving socket for one said electric receptacle device; and, (e) a plurality of switch devices each coupled to one of said second conducting plates, each said switch device being selectively actuable between at least first and second states, said switch device in said first state electrically coupling said second conducting plate to said first conducting plate and in said second state electrically decoupling said second conducting plate from said first conducting plate.

7. The integral multi-switch assembly as recited in claim 6 further comprising an electrically grounded conducting plate coupled to said switch box, said grounded conducting plate having extending therefrom at least one clip portion disposed outside said switch box to form a grounded electric plug receiving socket for one said electric receptacle device.

8. The integral multi-switch assembly as recited in claim 7 wherein each said clip portion is integrally formed.

9. The integral multi-switch assembly as recited in claim 6 wherein said clip portion is integrally formed.

10. The integral multi-switch assembly as recited in claim 6 wherein said grounded conducting plate includes a plurality of said clip portions longitudinally spaced one from the others in electrically coupled manner, said grounded conducting plate clip portions respectively forming said grounded electric plug sockets for said switch devices.

* * * * *